US006603264B1

(12) United States Patent
Hirao et al.

(10) Patent No.: US 6,603,264 B1
(45) Date of Patent: Aug. 5, 2003

(54) PLASMA DISPLAY PANEL HAVING A NON-REFLECTIVE GLASS LAYER

(75) Inventors: Kazunori Hirao, Yao (JP); Koji Aoto, Moriguchi (JP); Yoshihito Tahara, Ibaraki (JP)

(73) Assignee: Matsushita Electric Industrial of Co., Ltd., Osaka (JP)

( * ) Notice: Subject to any disclaimer, the term of this patent is extended or adjusted under 35 U.S.C. 154(b) by 0 days.

(21) Appl. No.: 09/280,712

(22) Filed: Mar. 30, 1999

(30) Foreign Application Priority Data

Mar. 31, 1998 (JP) ..... 10-085704

(51) Int. Cl.[7] ..... H01J 17/49; H01J 1/62

(52) U.S. Cl. ..... 313/586; 313/582

(58) Field of Search ..... 313/582, 583, 313/584, 585, 586, 587, 485, 486, 487, 495, 496, 497; 345/60; 445/24

(56) References Cited

U.S. PATENT DOCUMENTS

| | | | | |
|---|---|---|---|---|
| 5,336,121 A | * | 8/1994 | Baret | 445/25 |
| 5,541,479 A | | 7/1996 | Nagakubo | |
| 5,701,056 A | | 12/1997 | Shinohara | |
| 5,742,122 A | * | 4/1998 | Amemiya et al. | 313/582 |
| 5,757,131 A | * | 5/1998 | Tsuchiya | 375/582 |
| 5,793,158 A | * | 8/1998 | Wedding, Sr. | 313/493 |
| 5,828,356 A | * | 10/1998 | Stoller | 345/60 |
| 5,858,616 A | * | 1/1999 | Tanaka et al. | 430/28 |
| 5,952,782 A | * | 9/1999 | Nanto et al. | 313/584 |
| 6,333,600 B1 | * | 12/2001 | Mizobata | 313/582 |

FOREIGN PATENT DOCUMENTS

| | | |
|---|---|---|
| EP | 0 712 148 A | 10/1995 |
| EP | 0762463 A2 | 3/1997 |
| JP | 4-58436 | 2/1992 |
| JP | 5 101 776 A | 4/1993 |
| JP | 5-121002 | 5/1993 |
| JP | 5-314913 | 11/1993 |
| JP | 9-45249 | 2/1997 |
| JP | 10-269950 | 10/1998 |

OTHER PUBLICATIONS

Patent Abstract of Japan, vol. 010, No. 293(E–443), Oct. 4, 1986 and JP 61 110936 A (NEC Corp), May 29, 1986.
Patent Abstracts of Japan, vol. 010, No. 244 (E–430), Aug. 22, 1986 and JP 61 074239 A (Fujitsu Ltd), Apr. 16, 1986.

* cited by examiner

*Primary Examiner*—Nimeshkumar D. Patel
*Assistant Examiner*—Karabi Guharay
(74) *Attorney, Agent, or Firm*—Wenderoth, Lind & Ponack, L.L.P.

(57) ABSTRACT

A plasma display panel has spaced apart and parallel first and second substrates. A base 5 glass layer is provided on one surface of the second substrate confronting the first substrate. A plurality of spaced apart parallel ribs are positioned on the base glass layer and between the first and second substrates. Each rib defines a channel with a neighboring rib. A plurality of phosphors capable of emitting light are provided, each of which is positioned a corresponding channel. In particular, the base glass layer and/or ribs are made of material substantially impermeable to and non-reflective of light.

2 Claims, 8 Drawing Sheets

WHITE (TURNED-ON)
BLACK (TURNED-OFF)

BRIGHTNESS
100%

DISTANCE L
0
P

PLASMA DISPLAY PANEL HAVING A NON-REFLECTIVE GLASS LAYER

BACKGROUND OF THE INVENTION

The present invention relates to a display element and plasma display panel preferably used for an image display of a television or computer.

A conventional AC plasma display panel is illustrated in part in FIG. 5. As shown in FIG. 5, a plurality of scanning electrodes 4 and sustaining electrodes 5 that are parallel to each other are formed on a first insulative substrate 1. The scanning electrodes 4 and the sustaining electrode 5 are covered with a dielectric layer 2 and a protective layer 3. On a second insulative substrate 6, which faces the first insulative substrate 1, a plurality of data electrodes 7 that are parallel to each other are formed orthogonally to the scanning electrodes 4 and the sustaining electrodes 5. The data electrodes 7 are covered with a base glass layer 8 made of white material. A plurality of ribs 9 also made of white material are formed on the base glass layer 8. The ribs 9 are arranged so that each cooperates with a neighboring rib to define a channel adjacent to and along a data electrode 7. A phosphor 10 is provided in each channel to cover opposing side walls of the neighboring ribs, and a part of the base glass layer is exposed between the neighboring ribs, so that a discharge chamber 11 is defined on and along a phosphor 10.

As can be seen in the drawing, the neighboring scanning and sustaining electrodes, 4 and 5, are paired so that an electric discharge can be produced with aid of the data electrode 7 in a restricted region of the discharge chamber 11. The electric discharge generates ultraviolet light that excites an adjacent part of a phosphor 10. The excited portion of the phosphor 10 emits visible light for displaying an image. In this manner, each area where a data electrode 7 crosses a pair of scanning and sustaining electrodes, 4 and 5, defines a discharge cell 12 as hatched in FIG. 5.

As shown in the drawing, three neighboring phosphors 10, each separated by the ribs 9, constitute a red phosphor 10R, a green phosphor 10G, and a blue phosphor 10B, respectively, in this order. Selected and used for the white material of both the base glass layer 8 and ribs 9 is, for example, a white glass that is reflective of visible light. Preferably, a thickness of the base glass layer 8 is as small as possible to minimize a voltage for driving the data electrodes 7. For this reason, typically, the base glass layer has a thickness of about 10 to 15 micrometers. Also, a thickness of the ribs 9 is as small as possible to maximize an opening area of the discharge chamber 11. For this reason, typically, each of the ribs 9 has a thickness of about 20 to 60 micrometers.

Referring to FIG. 6 illustrating a cross sectional view taken along lines VI—VI in FIG. 5, descriptions will be made to functions of the base glass layer 8 and ribs 9. FIG. 6 shows that only the green phosphor 10G is excited for emitting green light. For clarity of the drawing and illustrative purpose, only a few light passes are illustrated in the drawing, which passes may not be depicted correctly from an optical standpoint.

As shown in the drawing, ultraviolet light generated by the discharge between the scanning and sustaining electrodes, 4 and 5, with aid of the data electrode 7 excites the green phosphor 10G. This causes the green phosphor 10G to emit green light to be projected through the first insulative substrate 1 as depicted by the arrows in FIG. 6, displaying a corresponding image. At this moment, part of the green light emitted from a surface of the green phosphor 10G is reflected toward surfaces of the base glass layer 8 and ribs 9 and then transmitted through the first substrate 1 for displaying. This is so because, the base glass layer 8 and the ribs 9 are made of white material, for example, white glass, which is reflective of visible light.

With this arrangement, a brightness of the display panel is increased to a certain extent. However, the white material can reflect only about 50 to 60 percent of the visible light. Beyond that, the structure does not improve the brightness of the panel much. In addition, the remaining 40 to 50 percent of the light is transmitted into the white material where it may be damped. Disadvantageously, several to several tens percent of the light can reflect from the white material, which may provide an adverse effect.

FIG. 7 is a graph illustrating a relationship between thickness of the phosphor and brightness of light from the display panel. In this graph, thickness-brightness characteristic curve A is for the base glass layer 8 and ribs 9 having reflectance of 60 percent, and curve B is for the base glass layer and ribs having reflectance of zero percent. This graph shows that if the thickness is lower than about 15 micrometers the brightness increases with the thickness due to the reflected light from the base glass layer 8 and the ribs 9, and if the thickness is greater than about 25 micrometers the brightness no longer increases much. This means that it is effective to increase the thickness of the phosphor for increasing the brightness of the panel.

Next, referring to FIG. 8 which is a cross sectional view taken along lines VI—VI in FIG. 5, another description will be made with regard to the adverse effect of the transmitted light from the base glass layer and ribs. FIG. 8 illustrates that the discharge cells 12 of the red and green phosphors, 10R and 10G, are excited to emit respective light, but the discharge cell 12 of the blue phosphor 10B is not excited. For clarity of the drawing and illustrative purpose, only a few light passes are illustrated in the drawing, which passes may not be depicted correctly from an optical standpoint.

In this instance, as shown by solid lines or arrows, the red and green visible light emitted from the surfaces of red and green phosphors, 10R and 10G, respectively, is transmitted through the first substrate 1 for display. Likewise, as shown by dotted lines or arrows, red and green visible light emitted into the interior of the elements is reflected by the surfaces of the base glass layer 8 and ribs 9, then transmitted through the elements and then transmitted through the first substrate 1 for display.

Contrary to this, as shown by phantom lines or arrows, the visible light transmitted from the red and green phosphors, 10R and 10G, is further transmitted from the base glass layer 8 and ribs 9. A portion of light transmitted from the base glass layer and ribs may travel through neighboring phosphors for different colors. In this instance, the display light from the red phosphor 10R can merge with that from the green phosphor 10G. This will degrade purity of respective colors. In addition, another portion of light transmitted from the base glass layer and ribs may travel through a portion of the first substrate 1 facing the discharge cell 12 that is not excited, which disadvantageously serves as an additional light for display. In this instance, green light from the green phosphor 10G is emitted through the discharge cell of blue phosphor 10B which is not excited, which is referred to as "halation".

The above-described problems, i.e., degradation of color purity and halation, are common to the conventional plasma display panels irrelevant of the number of discharge cells or display colors from discharge cells.

SUMMARY OF THE INVENTION

Accordingly, a plasma display panel according to the present invention has spaced apart and parallel first and second substrates substrate. A base glass layer is provided on one surface of the second substrate confronting the first substrate. A plurality of spaced apart parallel ribs are positioned on the base glass layer and between the first and second substrates. Each rib defines a channel with a neighboring rib. A plurality of phosphors capable of emitting light are provided, each of which is positioned in a channel. In particular, the base glass layer and/or ribs are made of material that is substantially impermeable to and non-reflective of visible light. With this arrangement, due to the material being substantially impermeable to and non-reflective of visible light, color purity is improved and halation is reduced, thereby allowing a high quality image to be displayed.

DETAILED DESCRIPTION OF THE PREFERRED EMBODIMENTS

With reference to the drawings, an embodiment of a plasma display panel according to the present invention will be described in detail hereinafter.

Figure 1:
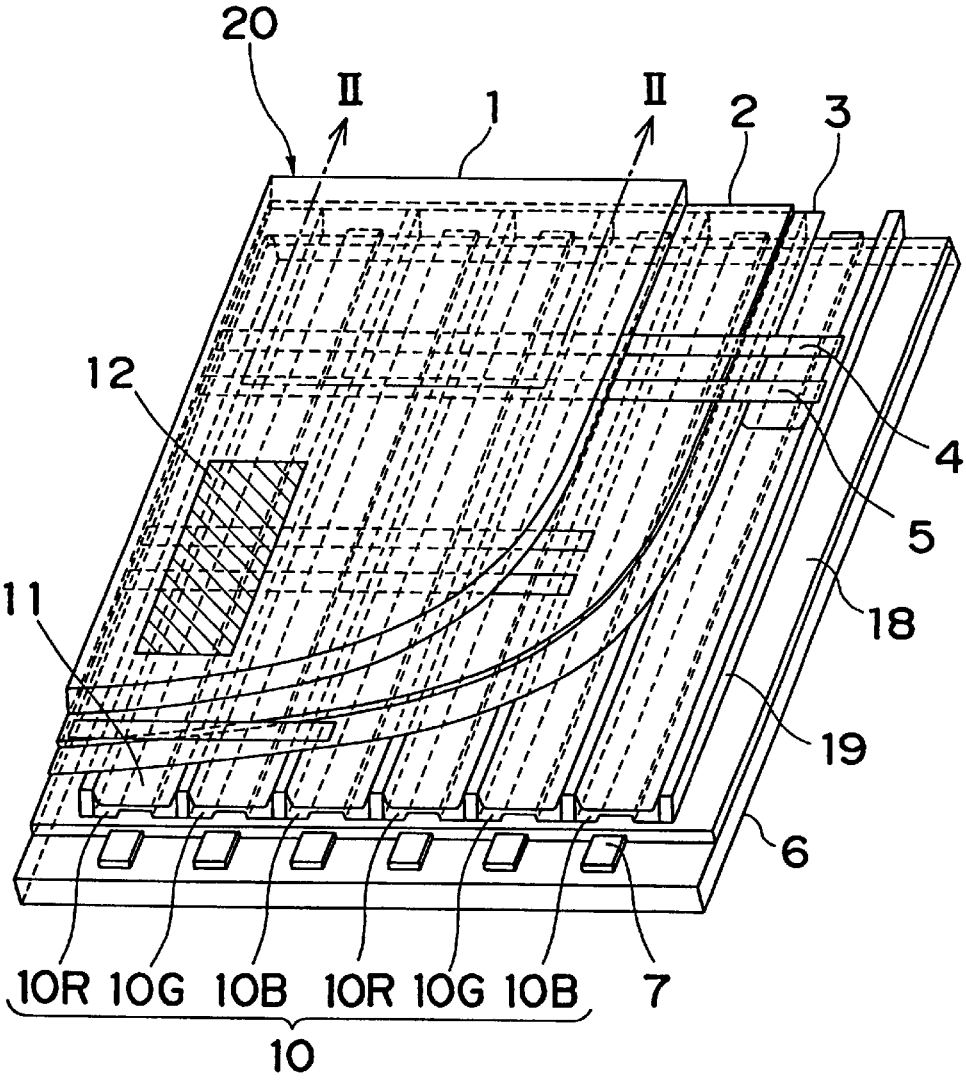
FIG. 1 is an enlarged partial perspective view of a plasma display panel of the present invention.
Figure 5:
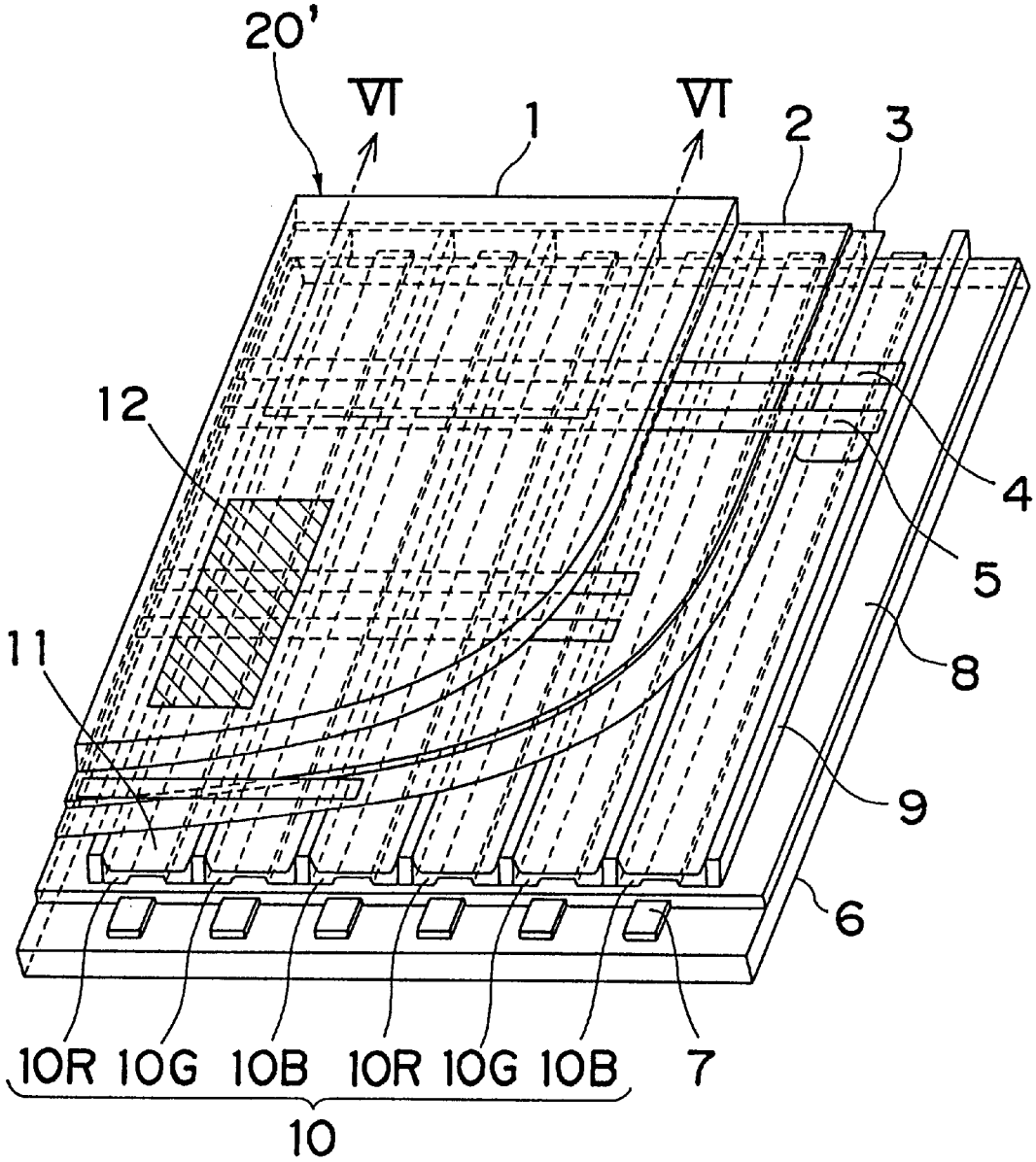
Fig. 5 PRIOR ART
FIG. 5 is an enlarged partial perspective view of a prior art plasma display panel.
Figure 6:
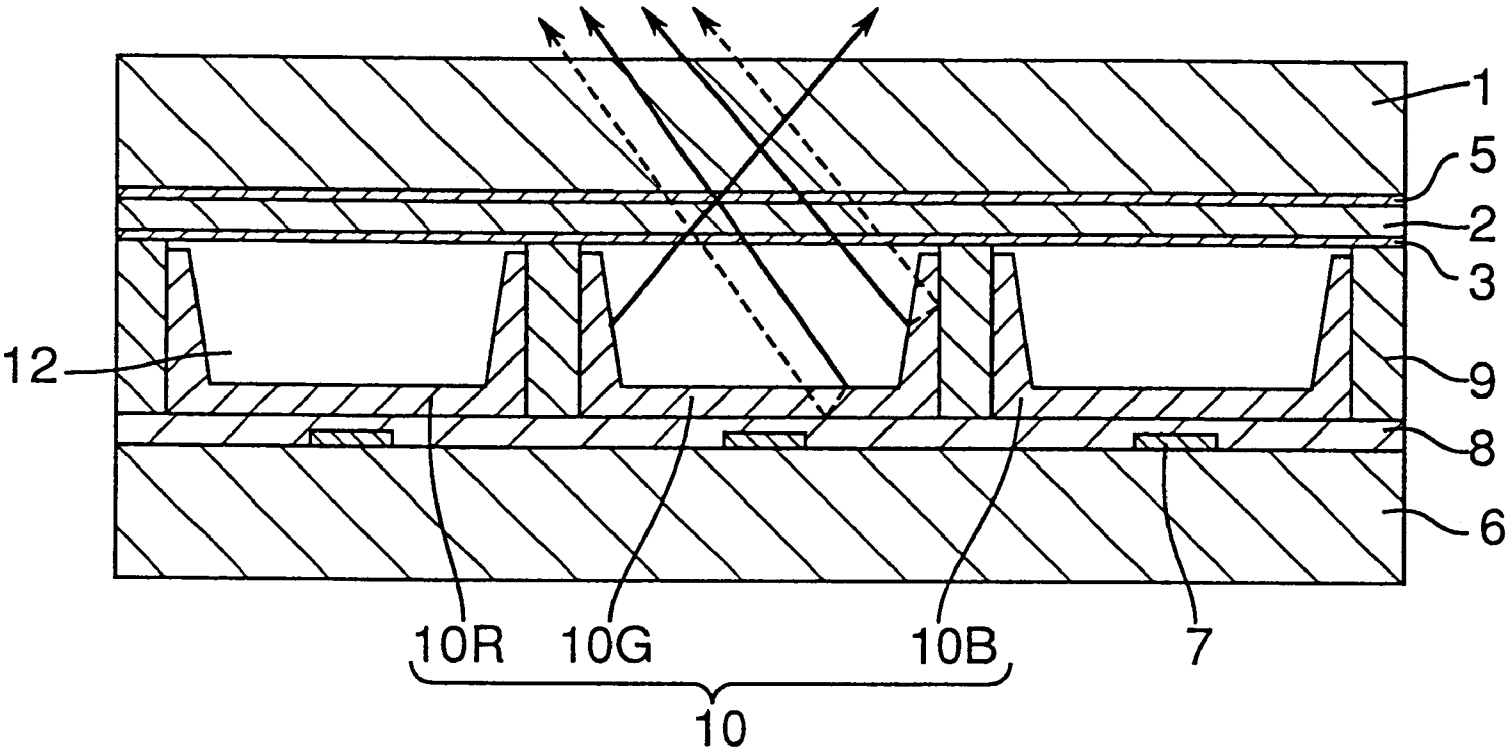
Fig.6 PRIOR ART
FIG. 6 is an enlarged cross sectional view of the plasma display panel taken along lines VI—VI in FIG. 5, showing passes of visible light from a discharge cell for green light.
Figure 7:
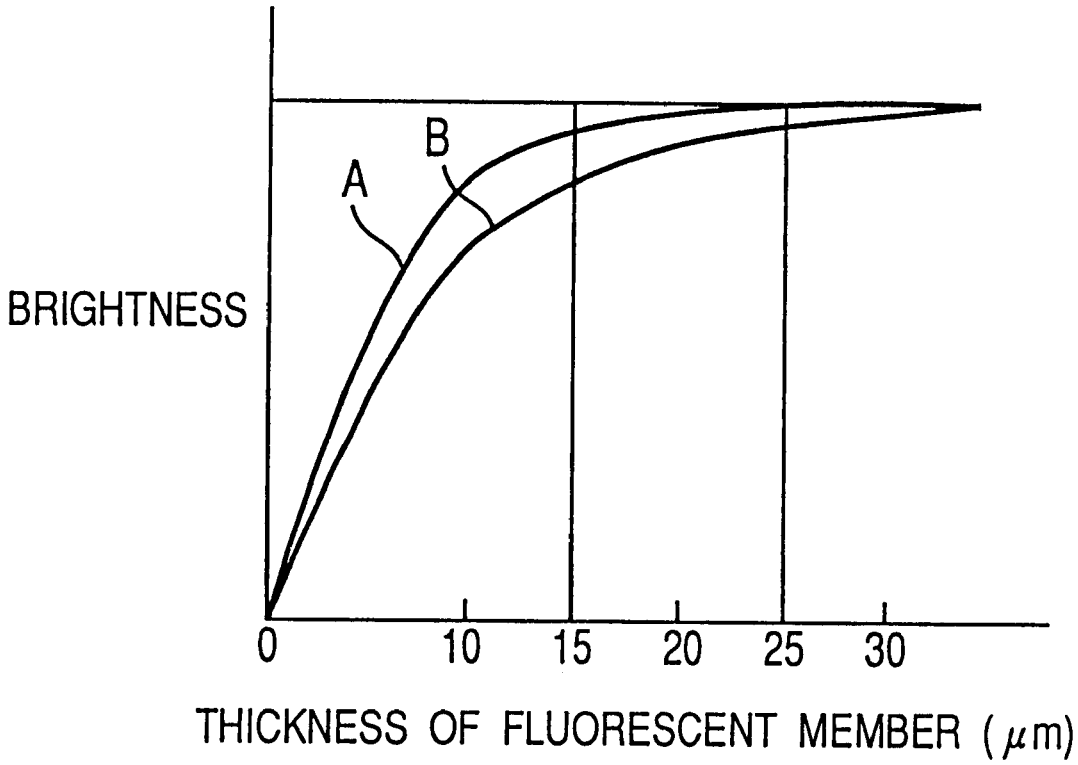
Fig.7 PRIOR ART
FIG. 7 is a graph showing a relationship between thickness of a phosphor and brightness of visible light emitted.
Figure 8:
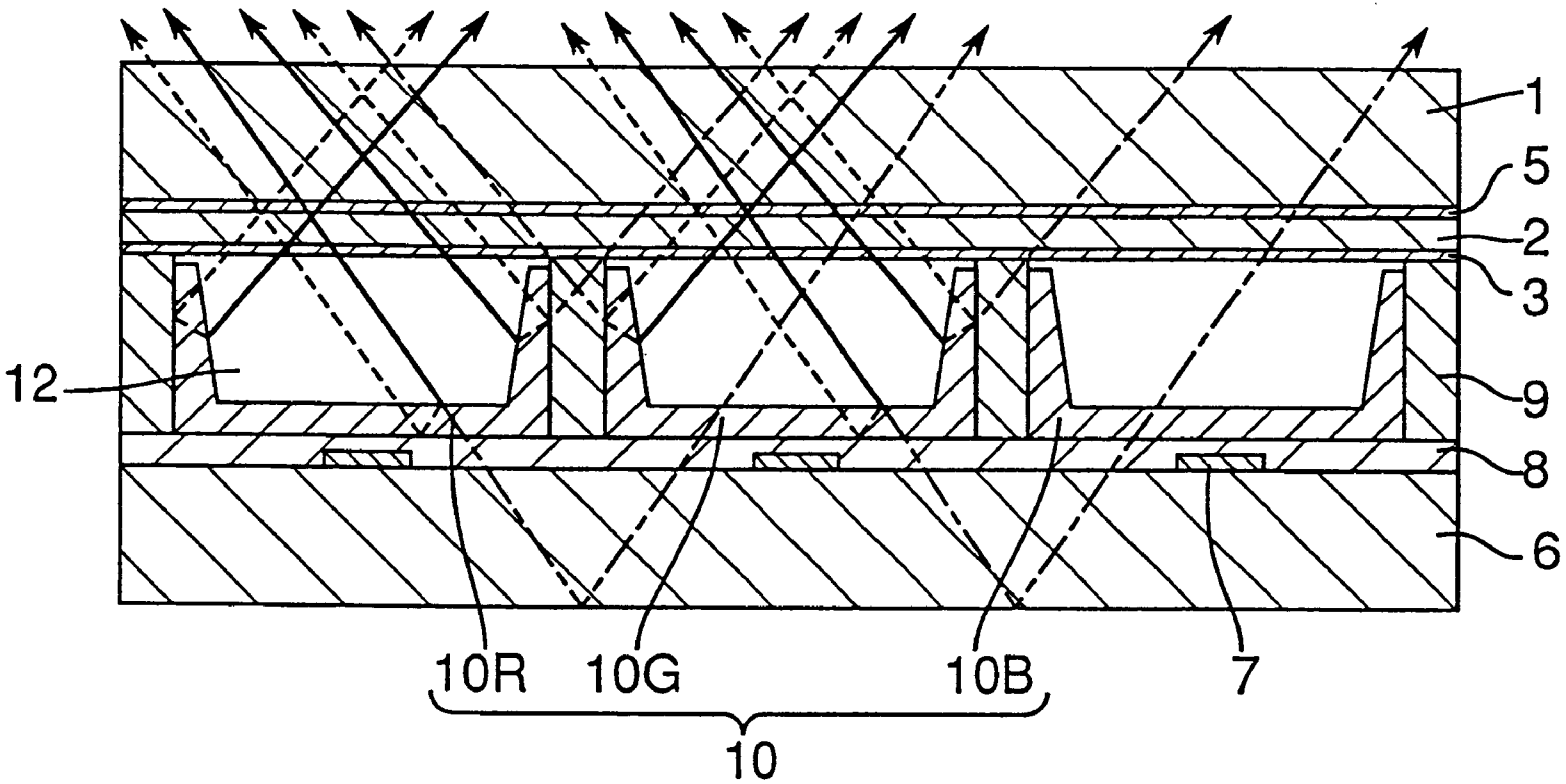
Fig.8 PRIOR ART
FIG. 8 is another enlarged cross sectional view of the plasma display panel taken along lines VI—VI in FIG. 5, showing passes of visible light from discharge cells for red light and green light.

FIG. 1 illustrates a partial enlarged perspective view of the plasma display panel of the present invention, generally indicated by reference numeral 20. As can be seen from the drawing, a structure of the display panel 20 of the present invention is substantially identical to the plasma display panel 20' illustrated in FIG. 5. Therefore, descriptions of the structure of the plasma display panel 20 are omitted, and like reference numerals are provided for like parts and assemblies performing the same function in FIGS. 1 and 5.

Differences between the plasma display panels, 20 and 20', are materials of the base glass layer and ribs. Specifically, although the material of base glass layer 8 and ribs 9 of the prior art plasma display panel 20' has a white color, the corresponding base glass layer 18 and ribs 19 of the plasma display panel 20 of the present invention are made of material substantially impermeable to and non-reflective of light. For this purpose, the base glass layer 18 and ribs 19 of the plasma display panel 20 are made of material having a dark color, preferably black. Examples of such materials are manganese (Mn), chromium (Cr), cobalt (Co) and nickel (Ni). It is to be understood that the base glass layer 18 and ribs 19 may include any one or more such materials.

Figure 2:
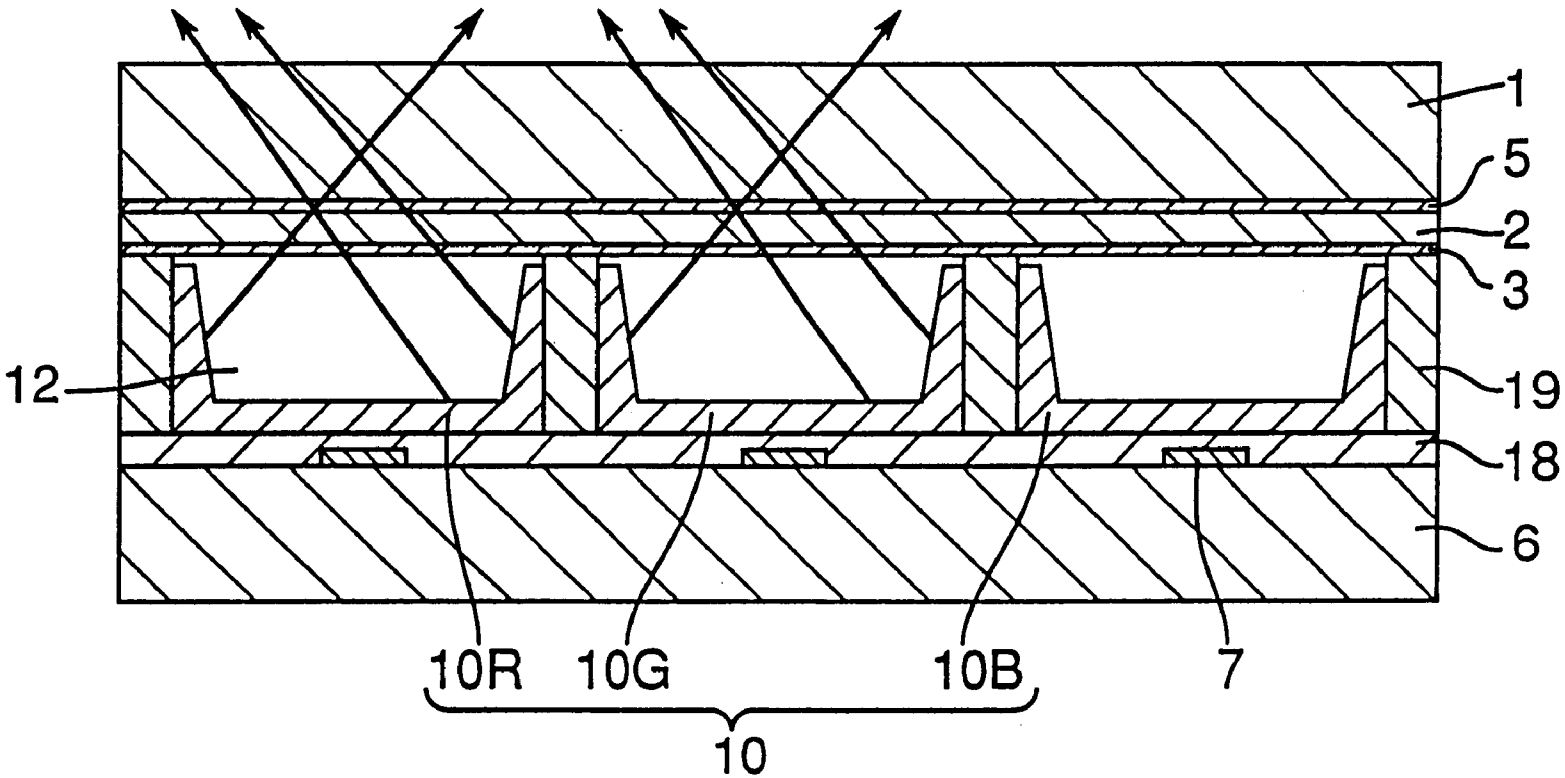
FIG. 2 is an enlarged cross sectional view of the plasma display panel taken along lines II—II in FIG. 1.

With reference to FIG. 2, functions and resultant effects of the base glass layer 18 and ribs 19 made of a black material will be described in detail hereinafter. FIG. 2 illustrates that red and green phosphors, 10R and 10G, of a discharge cell 12 are excited while a blue phosphor 10B thereof is not excited.

In this instance, the red and green phosphors, 10R and 10G, excited by ultraviolet light due to a maintaining discharge between scanning and sustaining electrodes, 4 and 5, emit red and green light, respectively. Red and green light emitted from surfaces of the red and green 10 phosphors, 10R and 10G, to an exterior thereof is transmitted through a first substrate 1 for displaying an image. On the other hand, red and green light emitted from the surfaces of the red and green phosphors to an interior thereof is absorbed, rather than reflected, at surfaces of the base glass layer 18 and ribs 19, adjacent to the phosphors, and is prevented from returning through respective phosphors and then travelling through the first substrate 1. This is so because, as described above, the base glass layer 18 and ribs 19 are made of a black material capable of absorbing and not reflecting light. Also, no red or green light emitted by corresponding phosphors 10R/10G is transmitted by or through the base glass layer 18 or ribs 19. This prevents red or green light from being transmitted into the adjacent discharge cell 12 where it could otherwise serve as display light.

Therefore, according to the present invention, light emitted from one phosphor (e.g., 10R) of one discharge cell 12 will never merge or mix with light emitted from a phosphor (e.g., 10G or 10B) of an adjacent discharge cell 12. This ensures that the light emitted from a corresponding phosphor appears to have a correct color, for example, pure red, green, and blue. In addition, no light (e.g., red light) is transmitted into an adjacent discharge cell for a different color (e.g., green and blue) where it would otherwise be used for display. This ensures that the discharge cell whose phosphor (e.g., 10B) is not excited will never emit visible light. This further ensures that no halation will result.

Although both the base glass layer and ribs are made of material impermeable to and non-reflective of light, the present invention is not limited thereto. That is, either the base glass layer or ribs may be made of black material substantially impermeable to and non-reflective of light. When the base glass layer 18 is made of black material, it will absorb light which would otherwise be transmitted by the base glass layer into an adjacent discharge cell. When, on the other hand, the ribs 19 are made of black material, they will absorb light which would otherwise be transmitted by or through the ribs into an adjacent discharge cell. Therefore, even when either the base glass layer or ribs are made of black material, both color purity and halation are improved to some extent.

Descriptions will be made to an evaluation of a halation effect of the panel according to the present invention.

Figures 3A, 3B, 4:
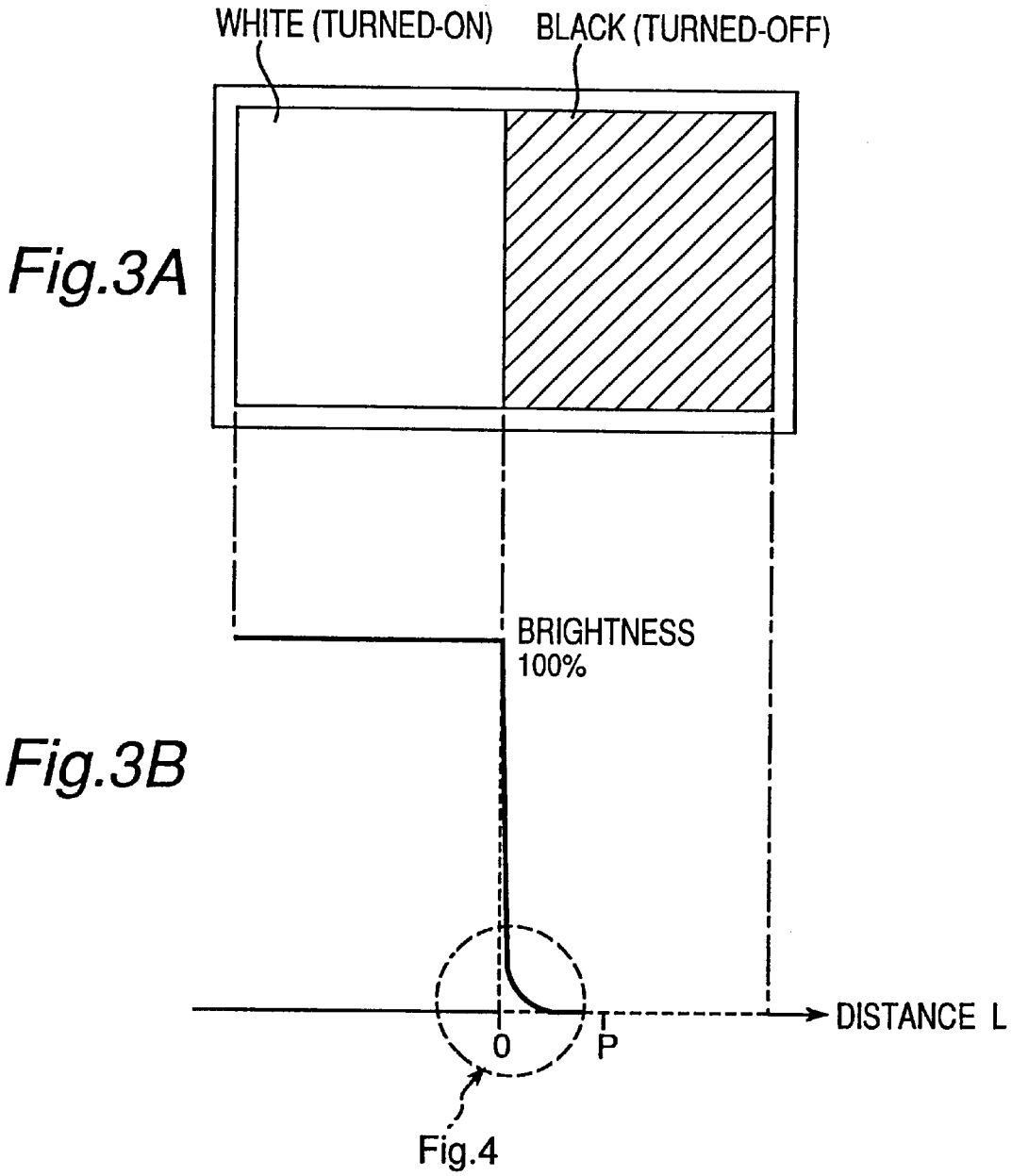
FIG. 3A is a front view of the plasma display panel in which all the discharge cells in the left half are turned on and all the discharge cells in the right half are turned off.
FIG. 3B is a graph showing a distribution of brightness along a central horizontal line in the panel shown in FIG. 3A.
FIG. 4 is a graph showing a relationship between a distance from a boundary of left and right halves and brightness measure.
Figure 4:
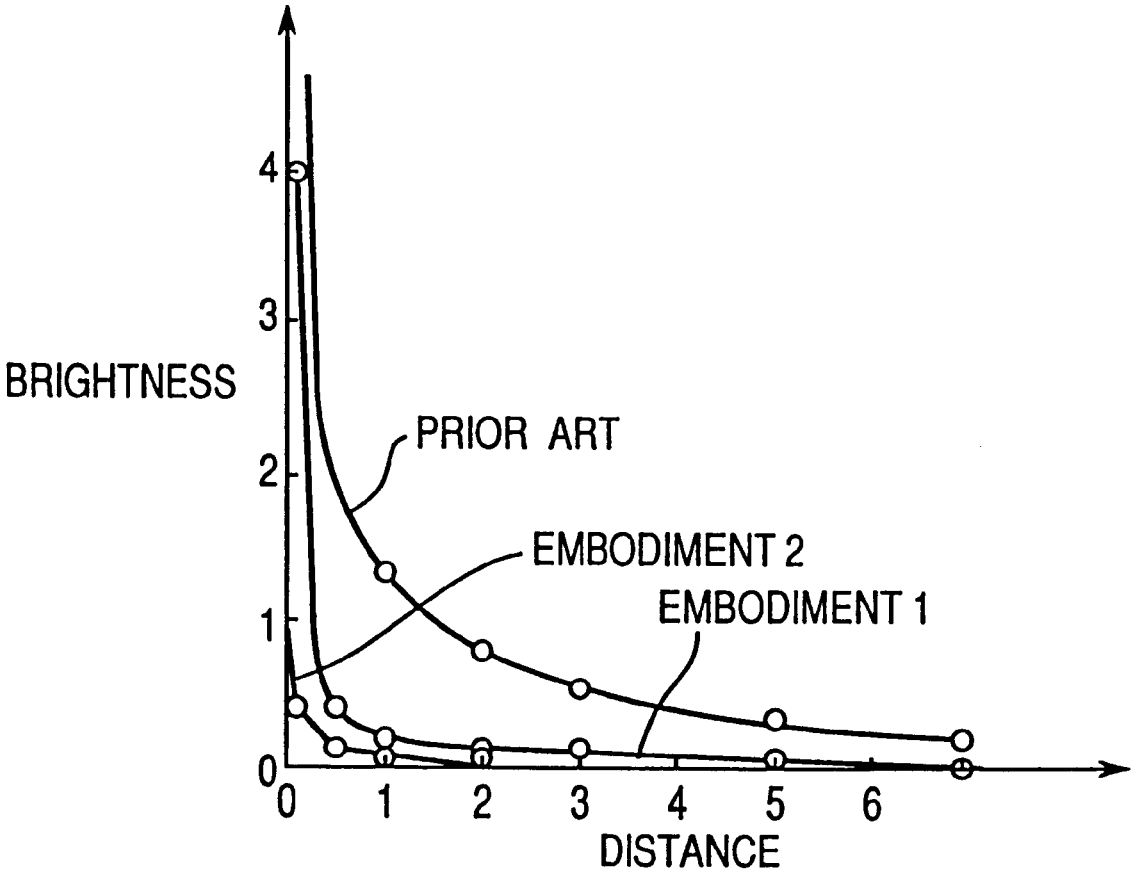

Assume that each of the discharge cells in the left half of the panel are turned on, i.e., excited to emit light, and each of the discharge cells in the right half of the panel are turned off, i.e., not excited. In this instance, ideally, i.e., if no halation exists in the panel, the left half of the panel represents white (i.e., 100 percent brightness) and the right half represents black (i.e., zero percent brightness), so that the brightness changes from 100 to zero percent at a boundary between the left and right halves without any gradation, which is shown by a dotted line in FIG. 3B. Actually, however, due to halation caused by various reasons, as shown in FIG. 3B, although the brightness in the left half has 100 percent brightness, it decreases gradually from 100 to zero percent in a zone adjacent to the left half in the right half. An increase of a distance from the boundary to a position where the brightness would reach substantially zero makes boundaries or edges of white or black images unclear, which degrades a contrast and purity of two colors.

In the actual evaluation, three panels were a prepared; first panel (Prior-art) having base glass layer and ribs of white material, a second panel (Embodiment 1) having a base glass layer of black material and ribs of white material, and a third panel (Embodiment 2) having a base glass layer and ribs of black material. Thickness of the base glass layer and ribs were set to 10 micrometers and 20 micrometers, respectively. For each panel, brightness distribution was measured along a central horizontal line. The measurement result is graphed in FIG. 4, which shows a relationship between a distance (L) from the boundary of left and right halves and relative brightness measured.

The graph shows that halation reduces as the brightness decreases rapidly. Also, the second and third panels (Embodiments 1 and 2) of the present invention in which the base glass layer or/and ribs are black provides less halation than the prior art first panel in which both the base glass layer and ribs are white. Further, the third panel (Embodiment 2) in which both the base glass layer and ribs are black provides less halation than the second panel (Embodiment 1) in which only the glass layer is black.

The same results can be attained regardless of the number of discharge cells, color emitted from the discharge cells, or thickness of the phosphors, and color purity and halation will be improved according to the present invention.

Although in the previous embodiment the base glass layer is a single layer, the present invention can equally be applied to a multi-layered base glass layer. In this instance, at least one layer of the base glass layer may be made of material substantially impermeable to and non-reflective of visible light.

Also, although the present invention has been fully described in light of one specific AC plasma display panel, it can equally be applied to other AC and DC plasma display panels. In this instance, the base glass layer and/or ribs may be made of material substantially impermeable to and non-reflective of light, which improves color purity and possible halation.

In view of the above, with the present invention in which the base glass layer and/or ribs are made of black or dark material, obtained is a high quality plasma display panel having improved color purity of the displayed image and further having little halation.

It should be noted that this application is based upon Japanese Patent Application No. 10-85704, and the, description thereof is entirely incorporated herein by reference.

What is claimed is:

1. A display panel for emitting light, comprising:

a first substrate;

a second substrate parallel to and spaced from said first substrate;

a base glass layer on a surface of said second substrate that faces said first substrate, with said base glass layer being from 10 $\mu$m to 15 $\mu$m in thickness and also being substantially non-reflective of visible light;

at least two spaced apart parallel ribs on said base glass layer and between said first and second substrates, with each of said at least two spaced apart parallel ribs being from 20 $\mu$m to 60 $\mu$m in width and cooperating with an adjacent rib to define a channel therebetween; and at least one phosphor that is capable of emitting light, with each said at least one phosphor being greater than 25 $\mu$m in thickness and positioned within a respective said channel;

wherein said base glass layer and said at least two spaced apart parallel ribs are each made of material black in color, with said material including at lest one of manganese, chromium, cobalt and nickel and being capable of absorbing visible light.

2. The display panel according to claim 1, wherein said at least two spaced apart parallel ribs are made of glass.

* * * * *